US010294828B2

(12) United States Patent
Cecur

(10) Patent No.: US 10,294,828 B2
(45) Date of Patent: May 21, 2019

(54) HYDRAULIC LASH ADJUSTER

(71) Applicant: Eaton Srl, Turin (IT)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 53 days.

(21) Appl. No.: 14/412,467

(22) PCT Filed: Jul. 5, 2013

(86) PCT No.: PCT/EP2013/064263
§ 371 (c)(1),
(2) Date: Jan. 2, 2015

(87) PCT Pub. No.: WO2014/006185
PCT Pub. Date: Jan. 9, 2014

(65) Prior Publication Data

US 2015/0122220 A1 May 7, 2015

(30) Foreign Application Priority Data

Jul. 5, 2012 (GB) ..... 1211926.9

(51) Int. Cl.
*F01L 1/24* (2006.01)
*F01L 13/06* (2006.01)
(Continued)

(52) U.S. Cl.
CPC ..... *F01L 1/2405* (2013.01); *F01L 1/24* (2013.01); *F01L 1/2411* (2013.01); *F01L 1/267* (2013.01);
(Continued)

(58) Field of Classification Search
CPC ..... F01L 13/0005; F01L 13/06; F01L 13/065; F01L 1/2405; F01L 1/2411; F01L 1/245;
(Continued)

(56) References Cited

U.S. PATENT DOCUMENTS 3,406,668 A * 10/1968 Donnelly ..... F01L 1/245 123/90.55
3,650,251 A * 3/1972 Pelizzoni ..... F01L 1/245 123/90.57
(Continued)

FOREIGN PATENT DOCUMENTS

DE 19745907 A1 4/1999
DE 102008054011 A1 * 5/2010 ..... F01L 1/185
(Continued)

OTHER PUBLICATIONS

International Search Report PCT/EP2013/064263, dated Jul. 5, 2013, European Patent Office.

*Primary Examiner* — John M Zaleskas
(74) *Attorney, Agent, or Firm* — Leydig, Voit & Mayer, Ltd.

(57) ABSTRACT

A hydraulic lash adjuster for an engine valve train has a hydraulic lash adjusting arrangement for automatically compensating for lash in an engine valve train, and a lost motion arrangement for inhibiting motion induced in the valve train in response to a lift profile of a rotating cam from being transferred to an engine valve.

16 Claims, 9 Drawing Sheets

(51) Int. Cl.
*F01L 1/26* (2006.01)
*F01L 13/00* (2006.01)

(52) U.S. Cl.
CPC ..... *F01L 13/06* (2013.01); *F01L 2001/2433* (2013.01); *F01L 2013/105* (2013.01)

(58) Field of Classification Search
CPC ..... F01L 2013/105; F01L 2001/2433; F01L 2001/2438; F02D 13/04
USPC ..... 123/90.12, 90.16, 90.43, 90.46, 90.55, 123/90.57, 320, 321, 322
See application file for complete search history.

(56) References Cited

U.S. PATENT DOCUMENTS 3,786,792 A * 1/1974 Pelizzoni ..... F01L 1/2422 123/321
4,164,917 A * 8/1979 Glasson ..... F01L 13/06 123/321
4,373,477 A * 2/1983 Buente ..... F01L 1/25 123/90.46
4,419,977 A * 12/1983 Hillebrand ..... F02M 57/021 123/502
4,452,186 A * 6/1984 List ..... F01L 1/25 123/90.16
4,462,353 A * 7/1984 Arai ..... F01L 1/2405 123/198 F
4,522,169 A * 6/1985 Arai ..... F01L 1/2405 123/198 F
4,881,499 A * 11/1989 Dietrich ..... F01L 1/245 123/90.52
4,977,867 A * 12/1990 Rhoads ..... F01L 1/08 123/90.49
5,163,389 A * 11/1992 Fujikawa ..... F01L 13/0005 123/198 F
5,692,469 A * 12/1997 Rammer ..... F01L 13/06 123/321
5,862,784 A * 1/1999 Blowers ..... F01L 1/2405 123/90.35
5,931,132 A * 8/1999 Freeland ..... F01L 1/2405 123/90.19
6,196,175 B1 * 3/2001 Church ..... F01L 1/146 123/198 F
6,273,039 B1 * 8/2001 Church ..... F01L 1/146 123/198 F
6,273,057 B1 * 8/2001 Schwoerer ..... F01L 13/06 123/321
6,321,704 B1 * 11/2001 Church ..... F01L 1/146 123/198 F
6,425,358 B1 * 7/2002 Haas ..... F01L 1/2405 123/198 F
6,439,195 B1 * 8/2002 Warner ..... F01L 13/06 123/320
6,688,266 B1 * 2/2004 Church ..... F01L 1/146 123/90.16
6,718,923 B2 * 4/2004 Barth ..... F01L 1/24 123/90.52
6,718,940 B2 * 4/2004 Usko ..... F01L 1/24 123/322
6,866,014 B2 * 3/2005 Spath ..... F01L 1/146 123/90.16
7,152,576 B2 * 12/2006 Vanderpoel ..... F01L 1/08 123/321
7,156,062 B2 * 1/2007 Vanderpoel ..... F01L 1/16 123/90.39
7,484,483 B2 2/2009 Yang et al.
7,543,555 B2 * 6/2009 Genise ..... F01L 1/245 123/90.45
7,617,806 B2 * 11/2009 Schmidt ..... F01L 1/143 123/90.12
7,900,591 B2 * 3/2011 Roerig ..... F01L 1/2405 123/90.48
8,065,987 B2 * 11/2011 Yang ..... F01L 1/08 123/321
8,196,556 B2 * 6/2012 Hendriksma ..... F01L 1/24 123/90.16
2005/0092273 A1 * 5/2005 Cecur ..... F01L 1/18 123/90.16
2010/0006063 A1 * 1/2010 Dilly ..... F01L 13/06 123/347
2011/0079195 A1 * 4/2011 Dilly ..... F01L 1/24 123/321
2011/0220062 A1 * 9/2011 Sailer ..... F01L 1/053 123/321
2013/0000573 A1 * 1/2013 Sailer ..... F01L 1/181 123/90.12

FOREIGN PATENT DOCUMENTS

GB 2354551 A 3/2001
JP 59087218 A * 5/1984 ..... F01L 1/2405
JP 59182609 U 12/1984
JP 6062616 A 4/1985
JP 4178158 B2 * 11/2008 ..... F01L 1/185

* cited by examiner

HYDRAULIC LASH ADJUSTER

CROSS-REFERENCE TO RELATED APPLICATIONS

This application is a U.S. National Stage application under 35 U.S.C. § 371 of International Application No. PCT/EP2013/064263, filed on Jul. 5, 2013, and claims benefit to British Patent Application No. 1211926.9, filed on Jul. 5, 2012. The International Application was published in English on Jan. 9, 2014, as WO 2014/006185 A1 under PCT Article 21(2).

FIELD

The present invention relates to a hydraulic lash adjuster for use in an engine valve train assembly.

BACKGROUND

A typical hydraulic lash adjuster (HLA) comprises a first oil chamber defined between an outer body and a plunger assembly slidably mounted within the outer body, and a spring biased to enlarge the first oil chamber by pushing the plunger assembly outwardly from the outer body to extend the HLA. Typically, the HLA has a second oil chamber, defined by the plunger assembly and which is in fluid communication with the engine's oil supply. The first oil chamber and the second oil chamber are separated by a one way valve and oil flows from the second chamber into the first chamber through the one way valve when the HLA extends (and hence the first chamber enlarges) because the oil pressure in the second chamber becomes higher than that in the first chamber. Whereas oil can flow into the first pressure chamber via the one way valve, it can only escape the first pressure chamber very slowly, for example, via closely spaced leak down surfaces. Accordingly, a HLA can extend to accommodate any slack in a valve train assembly, such as between the cam and the roller but after it is extended, the incompressible oil in the first chamber provides sufficient rigid support for the HLA to open the valve when a rocker arm pivots (i.e. the incompressible oil prevents the plunger assembly being pushed back inwardly of the outer body so that the HLA acts as a solid body).

Compression engine brakes are typically used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is close to the top-dead-center position of its compression stroke so that compressed air is released through the exhaust valve. This causes the engine to function as a power consuming air compressor which slows the vehicle.

In a typical valve train assembly used with a compression engine brake, the exhaust valve is actuated by a rocker arm to provide an additional compression brake exhaust valve lift in addition to the main exhaust valve lift. The rocker arm rocks in response to a cam on a rotating cam shaft and acts on the exhaust valve, either directly, or indirectly (for example, by means of a valve bridge) to open it. Lost motion variable valve actuation systems may be used to inhibit the additional compression brake exhaust valve lift when the engine is in normal engine combustion mode.

A hydraulic lash adjuster may also be provided in the valve train assembly to remove any lash (i.e. gap) that develops between components in the valve train assembly.

U.S. Pat. No. 7,156,062 describes a valve actuation system that comprises a lost motion system and a separate, distinct automatic lash adjuster. The system is complicated and has a large number of distinct components.

U.S. Pat. No. 7,484,483 describes a variable valve actuation system that comprises a manual lash adjuster. Manual lash adjusters have the disadvantage of not providing automatic lash adjustment. Instead, a mechanic must adjust a manual lash adjuster during engine servicing.

SUMMARY

An aspect of the invention provides a hydraulic lash adjuster for an engine valve train, the adjuster comprising: a hydraulic lash adjusting arrangement configured to automatically compensate for lash in an engine valve train; and a lost motion arrangement configured to inhibit motion, induced in the valve train in response to a lift profile of a rotating cam, from being transferred to an engine valve.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An aspect of the invention provides a hydraulic lash adjuster for use in an engine valve train assembly, particularly, a hydraulic lash adjuster that provides a lost motion stroke variable valve actuation (VVA) capability.

Incorporating a lost motion arrangement into a HLA provides a system that is simpler has fewer components than known systems in which HLAs and lost motion systems are separate and distinct. This simplifies manufacturing and reduces costs.

An aspect of the invention provides a valve train including such an HLA.

Figure 1:
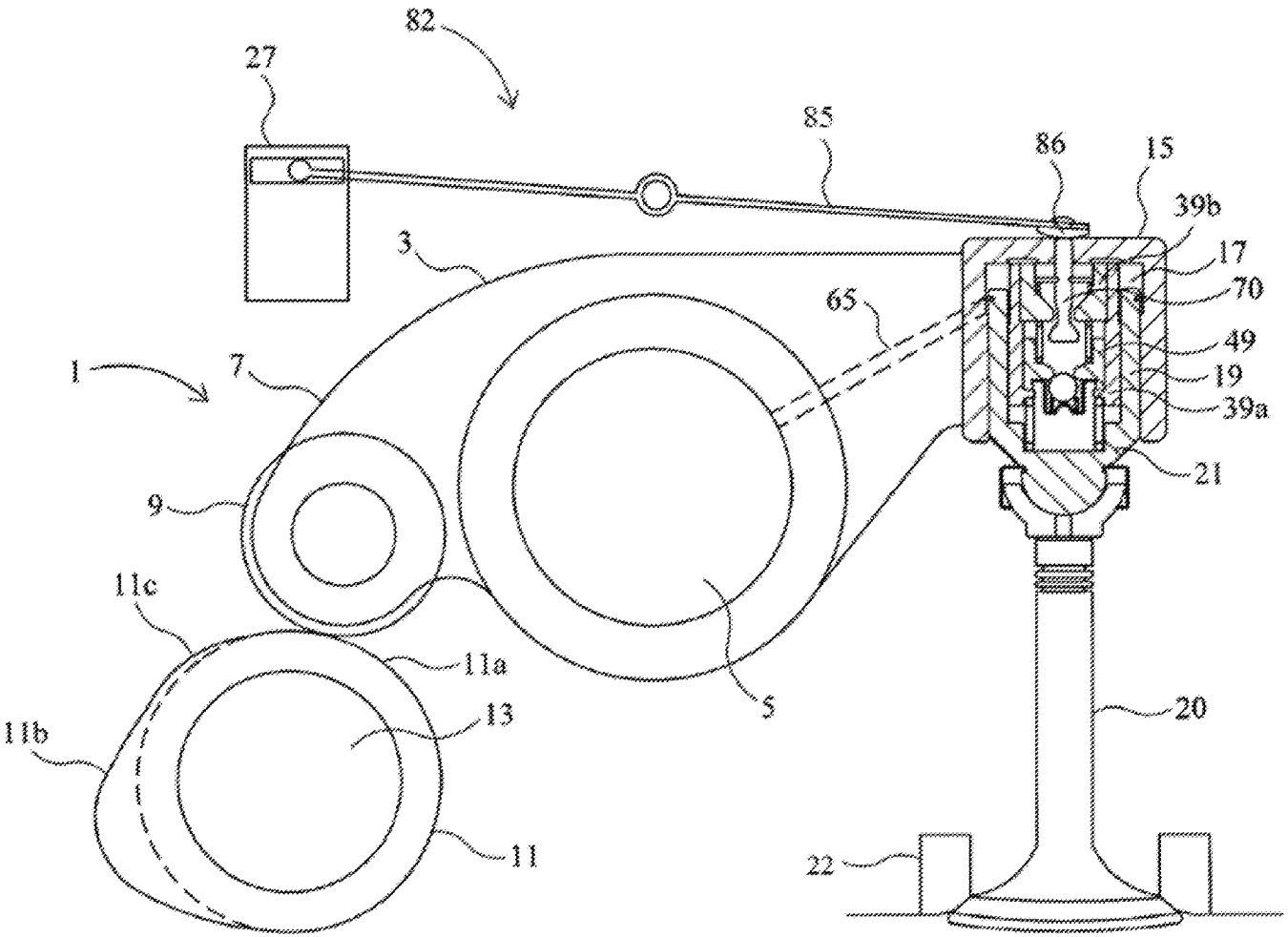
FIG. 1 is a schematic side view of a valve train assembly.

FIG. 1 schematically illustrates a valve train assembly 1 comprising an exhaust rocker arm 3, mounted for pivotal movement about a rocker shaft 5. The exhaust rocker arm 3 comprises, at a first end 7, a rotatably mounted roller 9 for engaging an exhaust cam 11 which is mounted or formed on a rotatable cam shaft 13. The exhaust cam 11 comprises a base circle 11*a*, a main exhaust lift profile 11*b* and an additional exhaust lift profile 11*c*.

As shown in FIG. 1, the exhaust rocker arm 3 comprises, at a second end 15, a cavity 17 in which is supported a Hydraulic Lash Adjuster (HLA) 19. The HLA 19 is for contacting an exhaust valve 20 of an engine cylinder 22.

Figure 2:
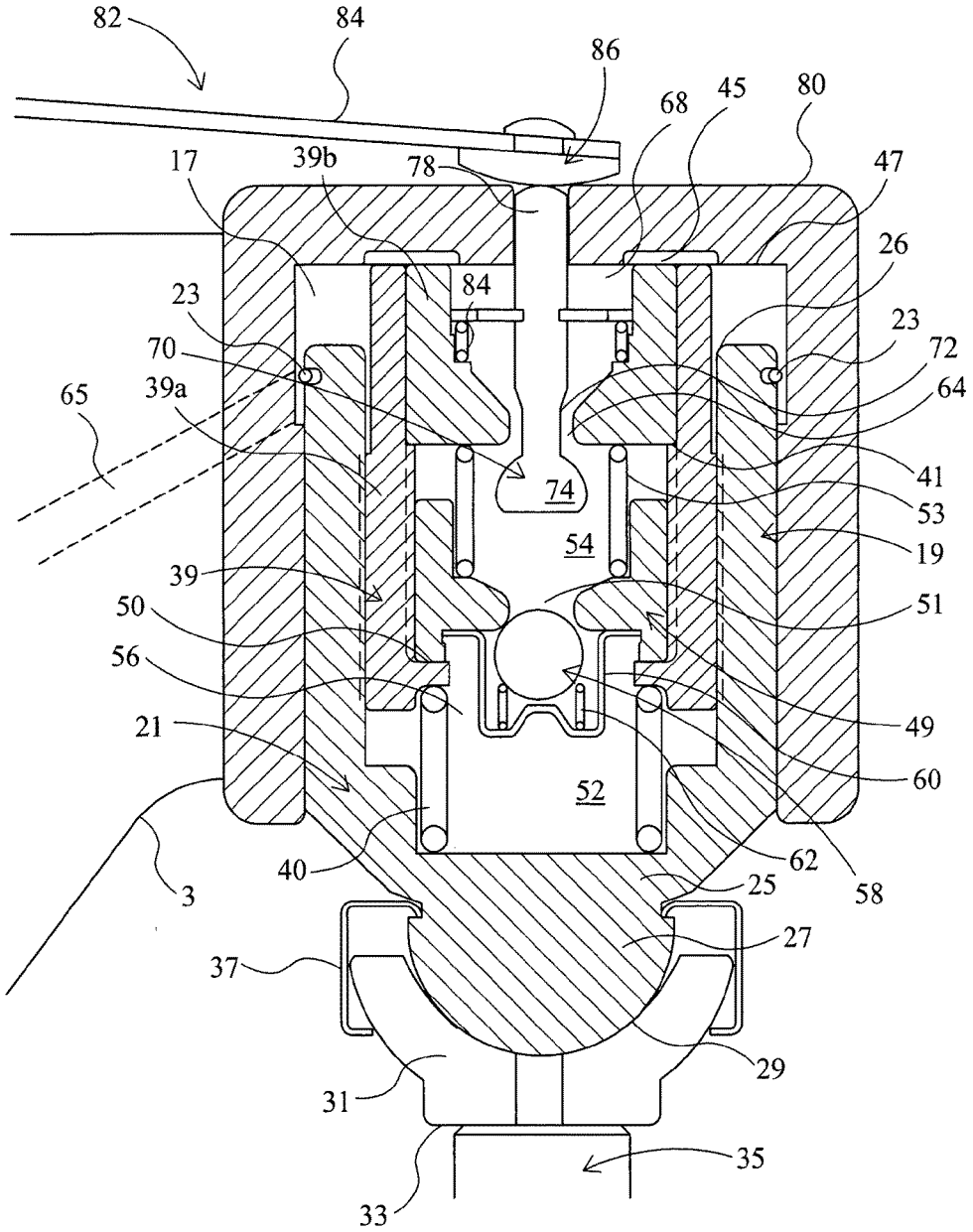
FIG. 2 is a schematic cross sectional side view of an HLA.

Referring to FIG. 2 the HLA 19 comprises a hollow outer body 21 supported within the cavity 17 by means of a first retaining clip 23. The hollow outer body 21 comprises a first closed end 25 which protrudes from the cavity 17 and defines a spigot 27 which is received in a socket 29 defined by an E-foot 31. The E-foot 31 comprises a flat base end 33 for contacting a stem 35 of the exhaust valve 20. The spigot 27 is retained within the socket 29 by means of a second retaining clip 37.

The HLA 19 comprises a first plunger 39 slidably mounted within the hollow outer body 21 and which extends above a second open end 26 of the hollow outer body 21. In this example, the first plunger 39 is a hollow two part component comprising a first hollow body 39*a* and a second hollow body 39*b*. The second body 39*b* rests co-axially within the first body 39*a*, for example, on a first annular lip 41 defined by the first hollow body 39*a*. A first biasing means 40, for example a compression spring, located at the first closed end 25 of the outer body 21 biases the first plunger 39 outwardly away from the outer body 21 such that a first open end 45 of the first plunger 39, defined by respective ends of the first 39*a* and second 39*b* hollow bodies, presses against an upper inner surface 47 of the cavity 17.

The HLA 19 further comprises a second plunger 49 slidably mounted within the first hollow body 39*a* of the first plunger 39. The second plunger 49 is coaxial with and opposes the second hollow body 39*b*. In the position shown in FIG. 2, the second plunger 49 rests upon a second annular lip 50 defined by the first hollow body 39*a*. The second plunger 49 defines a first aperture 51 for connecting a first chamber 52, defined by the hollow outer body 21, the first hollow body 39*a* and the second plunger 49, and a second chamber 54 defined by the first hollow body 39*a* the second plunger 49 and the second hollow body 39*b*.

The second oil chamber 54 contains a second biasing means 53, for example a compression spring, which biases the second plunger 49 away from the second hollow body 39*b*.

The HLA 19 is further provided with a check ball valve 56 which comprises a ball 58 captured by a cage 60 supported in the first chamber 52 by the second plunger 49 and is biased by a third biasing means 62, for example a small compression spring, to a position closing the first aperture 51.

In use, if a lash (i.e. a gap) develops between any of the components in the valve train assembly 1, the first biasing means 40 can expand the overall effective length of the HLA 19 by pushing the first plunger 39 away from the hollow outer body 21 so as to take up the slack in the valve train assembly 1. During the course of this motion, the ball valve 56 allows oil to flow from the second chamber 54 to the first chamber 52 through the first aperture 51 so that the first chamber 52 is maintained full of pressurised oil. The oil is prevented from flowing back from the first chamber 52 to the second chamber 54 by the ball valve 56. The HLA 19 therefore provides for automatic hydraulic lash adjustment.

The second hollow body 39*b* and the upper inner surface 47 of the rocker arm 3 define a third chamber 68 located above the second chamber 54. The second hollow body 39*b* defines a second aperture 64 that connects the third chamber 68 and the second chamber 54.

Oil is supplied to the third chamber 68 from the engine's oil supply via an oil supply conduit 65 formed through the rocker shaft 5 and exhaust rocker arm 3 into the HLA 19. Oil is supplied from the third chamber 68 into the second chamber 54 when the relief valve 70 is open. In effect, the second chamber 54 and the third chamber 68 act as an oil reservoir for supplying the first chamber 52 when the HLA 19 extends and for replenishing oil that escapes from the first chamber 52 via leak down surfaces (illustrated by vertical dashed lines), for example, when the HLA is under load during a valve lift event.

In this example, the relief valve 70 is a poppet valve comprising an elongate stem 72 that extends along the longitudinal axis of the third chamber 68 and terminates at a first end in a valve head 74 that forms a seal with the second hollow member 39*b* when the relief valve 70 closes the second aperture 64. Many other types of valve may instead be used. A second end 78 of the stem 72 extends through an upper wall 80 of the HLA 19 where it is contactable by an actuator 82 which is operable to push the relief valve 70 from a first position in which the second aperture 64 is closed, to a second position in which the second aperture 64 is open. A fourth biasing means 84 is located in the third chamber 68 and is arranged to bias the relief valve 70 to the position in which the second aperture 64 is closed.

In this example, the actuator 82 comprises a lever 85 having a contact head 86. When the relief valve 70 is in the first position in which it closes the second aperture 64, the lever 85 is in a position in which the contact head 86 is above and not in contact with the second end 78 of the valve stem 72. The lever 85 is moveable from this position into contact with the second end 78 of the valve stem 72 so as to push the relief valve 70 against the bias of the fourth biasing means 84 to open the second aperture 64. The lever 85 may be moved for example by an electro-magnetic system 27 controlled by an engine control system. Other types of actuators may be used to actuate the relief valve 70, for example, hydraulic actuators.

The HLA 19 is configurable by means of the actuator 82 to be in either a 'combustion mode' in which the relief valve 70 is open, or a 'braking mode' in which the relief valve 70 is closed. The 'combustion mode' corresponds to normal engine operation in which the engine cylinders provide power strokes. In contrast, the 'braking mode' corresponds to engine operation mode in which combustion is inhibited and de-compression engine braking is implemented.

In the braking mode, pivoting of the exhaust rocker arm 3 in response to the additional exhaust lift cam profile 11*c* engaging the roller 9 causes an additional valve lift of the exhaust valve 20, once per engine cycle, to provide a de-compression engine brake event. In contrast, in the combustion mode, the pivoting of the exhaust rocker arm 3 in response to the additional exhaust lift cam profile 11*c* engaging the roller 9 is absorbed by a variable valve actuation 'lost motion stroke' of the HLA 19 and so the additional valve lift of the exhaust valve 20 is inhibited.

Referring now to FIGS. 1, 3*a*, 3*b* and 4, the combustion mode of operation will be explained. As illustrated in FIG. 1, the cam shaft 13 is rotating clockwise in the sense of the page and the actuator 82 has configured the HLA 19 in combustion mode by pushing the relief valve 70 to open the second aperture 64. FIG. 1 shows the valve train assembly 1 when the roller 9 is engaged with the base circle 11*a* of the cam 11 and the exhaust valve 20 is closed, momentarily before the roller 9 begins to engage with the additional exhaust lift profile 11*c*.

Figure 3B:
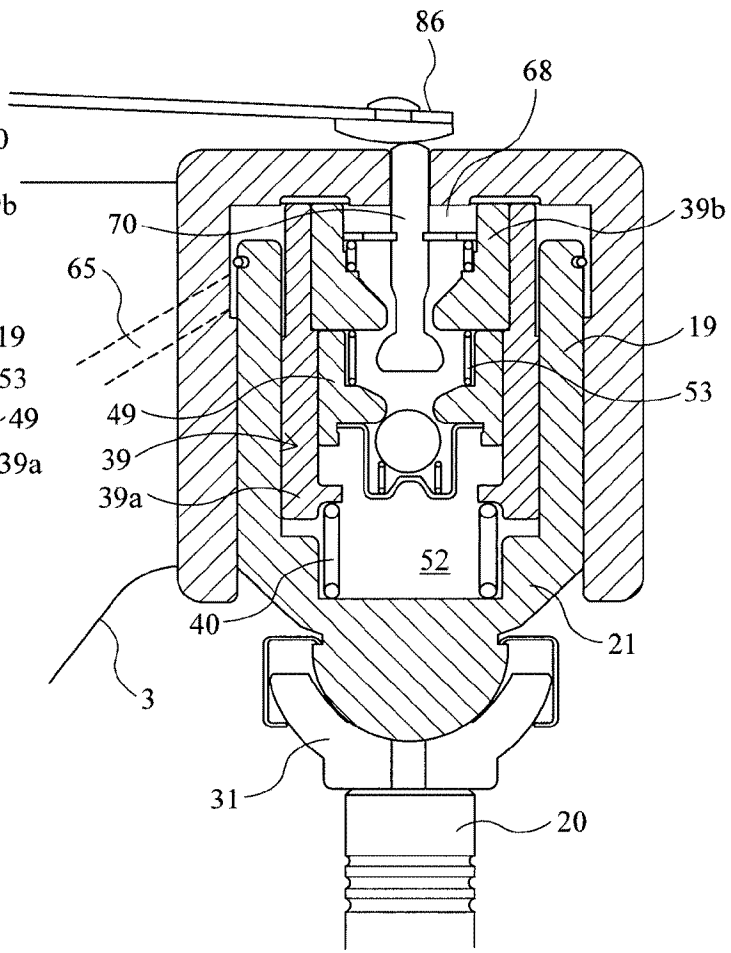
FIG. 3*b* is a schematic cross sectional side view of the HLA of FIG. 3*a* with its components in a first configuration.
Figure 3A:
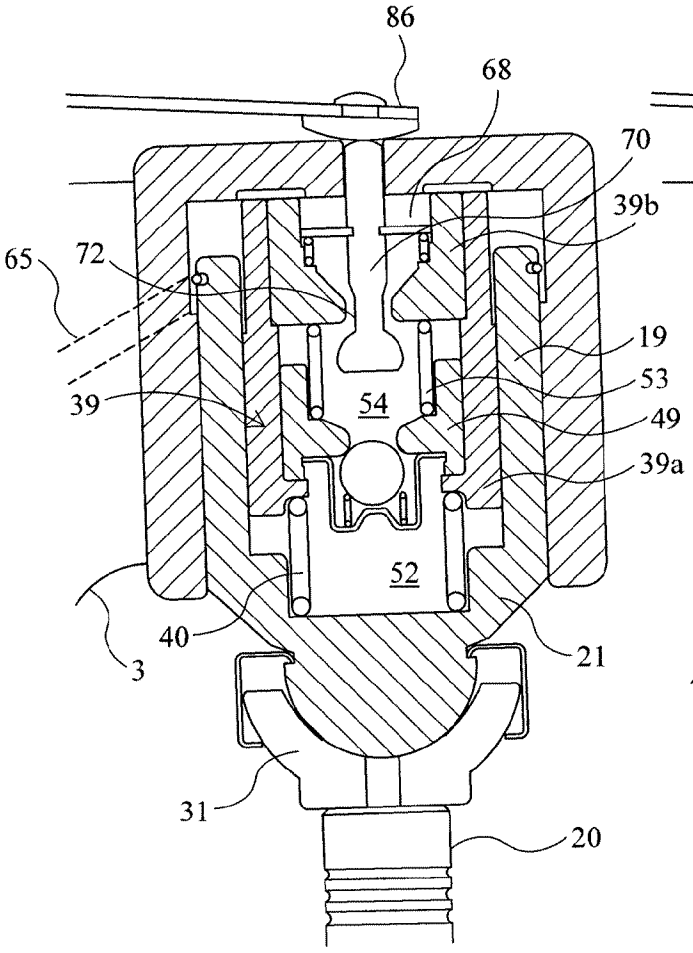
FIG. 3*a* is a schematic cross sectional side view of an HLA with its components in a first configuration.

FIG. 3*a* is an enlarged view of the HLA 19 as it is in FIG. 1 and shows the second plunger 49 resting upon the annular lip 50 formed around the bottom of the first hollow body 39*a* and that there is a gap between the second plunger 49 and the second hollow body 39*b*.

As the roller 9 starts to engage the leading rising slope of the additional exhaust lift profile 11*c*, the exhaust rocker arm 3 starts to pivot clockwise in the sense of the page. As the exhaust rocker arm 3 pivots, the upper inner surface 66 of the exhaust rocker arm 3 pushes the first plunger 39 inwardly of the hollow outer body 21 in the direction of the bottom of the first chamber 52. As the relief valve 70 is open, the movement of the first plunger 39 is able to displace oil in the first chamber 52 and the resultant pressure difference between the first chamber 52 and the second oil chamber 54 causes the second plunger 49 to move upwards towards the second hollow body 39*b*.

Figure 4:
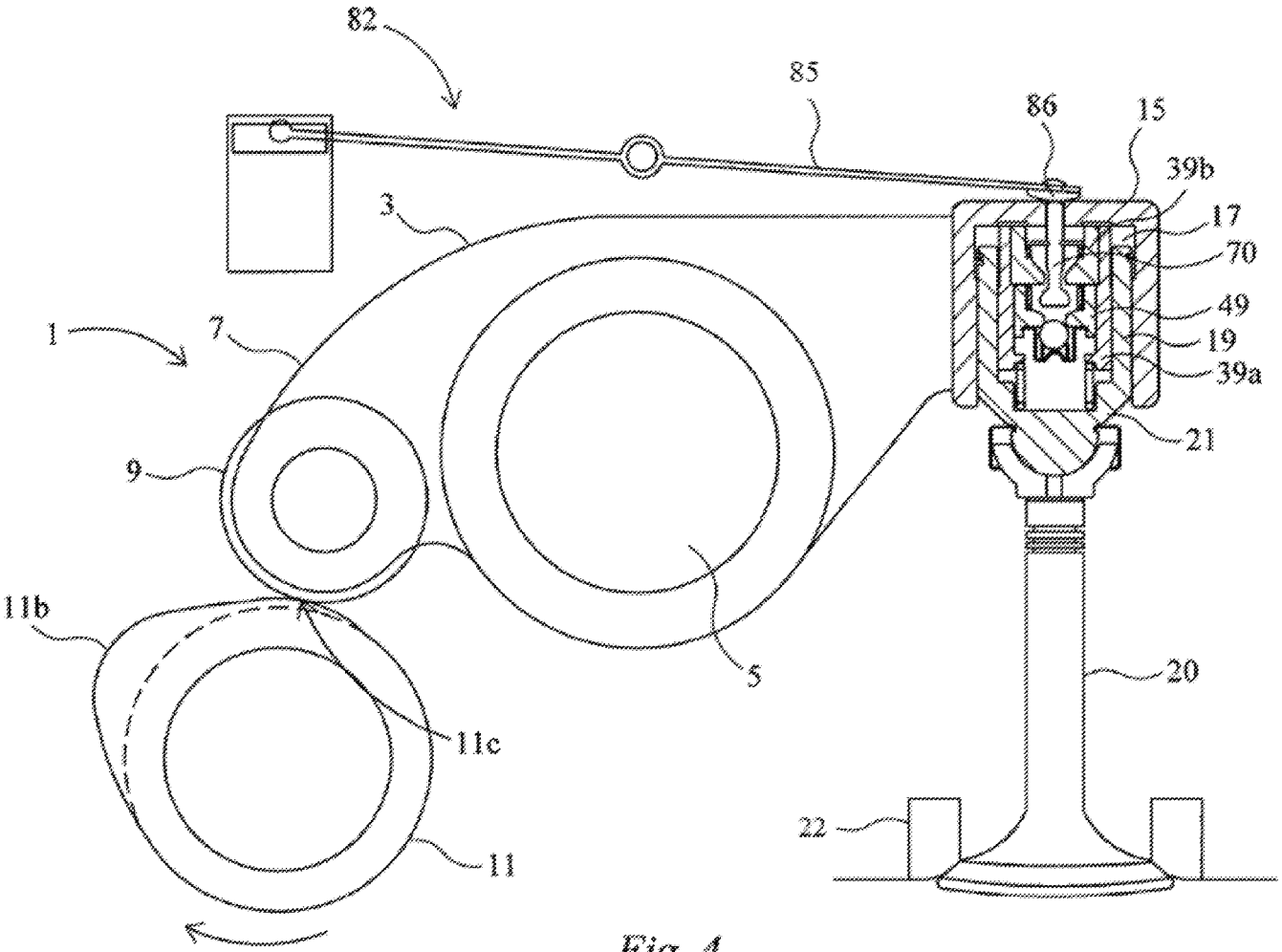
FIG. 4 is a schematic side view of a valve train assembly.

When the first plunger 39 and the second plunger 49 are moving in this way, the outer body 21 remains substantially stationary and no force sufficient to open the exhaust valve 20 is transmitted to it, despite the clockwise pivoting of the exhaust rocker arm 3. This could continue until the second plunger 49 hits the second hollow body 39*b*, at which point, the HLA 19 would begin to act as a solid body that would transmit an opening force to the exhaust valve 20, but in this example, even at the point at which the roller 9 engages the peak of exhaust lift profile 11*c*, as shown in FIG. 4, the second plunger 49 remains marginally out of contact with the second hollow body 39*b*, as shown in FIG. 3B, and so the exhaust valve 20 remains closed. In effect, the movement of the second plunger 49 provides for a so called 'lost motion stroke', in which the exhaust rocker arm 3 performs a pivoting stroke but the exhaust valve 20 remains closed.

When the roller 9 engages the rising slope of the main exhaust lift profile 11*b*, the exhaust rocker arm 3 pivots clockwise to a greater extent than when the roller 9 engages the rising slope of the additional exhaust lift profile 11*c*. This motion is sufficient for the second plunger 49 to hit the second hollow body 39*b* which acts as a stopper, at which point, the HLA 19 acts as a solid body due to the incompressible oil in the first chamber 52 and transmits an opening force to the exhaust valve 20 for the exhaust valve to open for the exhaust stroke of the engine cycle.

The maximum valve lift of the exhaust valve 20 occurs when the roller 9 engages the peak of the main exhaust lift profile 11*b*. As the roller 9 passes out of engagement with the peak of the main exhaust lift profile 11*b*, the exhaust rocker arm 3 starts to pivot anti-clockwise in the sense of the page and the exhaust valve 20 begins to close under the action of a valve return spring. When the roller 9 again becomes engaged with the base circle 11*a* the exhaust valve 20 is closed. Furthermore, the first plunger 39 returns under the bias of the first biasing means 40 from its position shown in FIG. 3*b* to its position shown in FIG. 3*a* and, the second plunger 49 returns under the bias of the second biasing means 53 from its position shown in FIG. 3*b* to its position shown in FIG. 3*a*.

Figure 5:
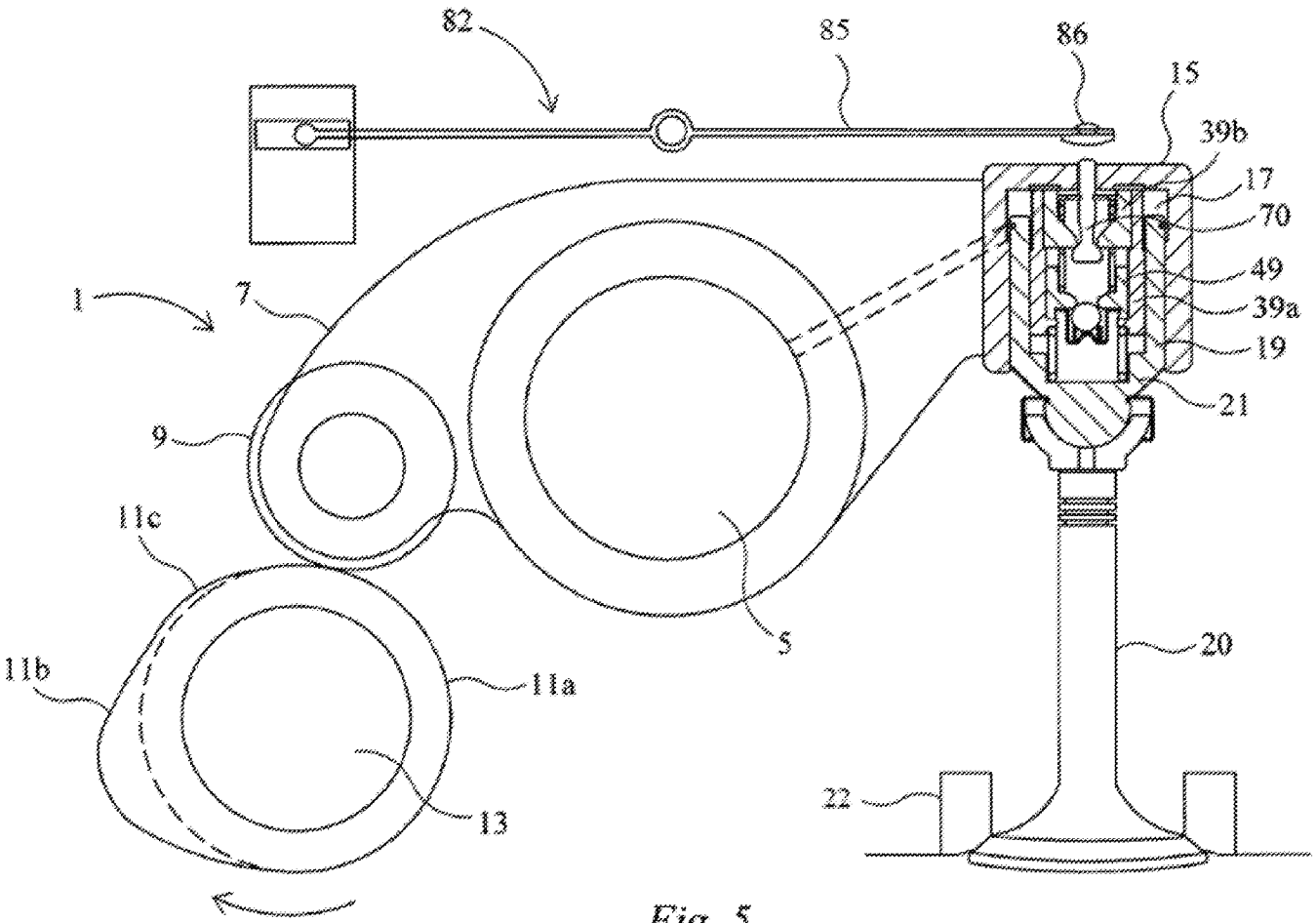
FIG. 5 is a schematic side view of a valve train assembly.

Referring to FIGS. 5, 6*a*, 6*b* and 7, the de-compression braking mode of operation will be explained. In this mode, the actuator 82 remains out of contact with the relief valve 70, which under the bias of the fourth biasing means 84 keeps the second aperture 72 closed. FIG. 5 shows the valve train assembly 1 when the roller 9 is engaged with the base circle 11*a* of the cam 11 and the exhaust valve 20 is closed, momentarily before the roller 9 commences to engage with the additional exhaust lift profile 11*c*.

Figure 6B:
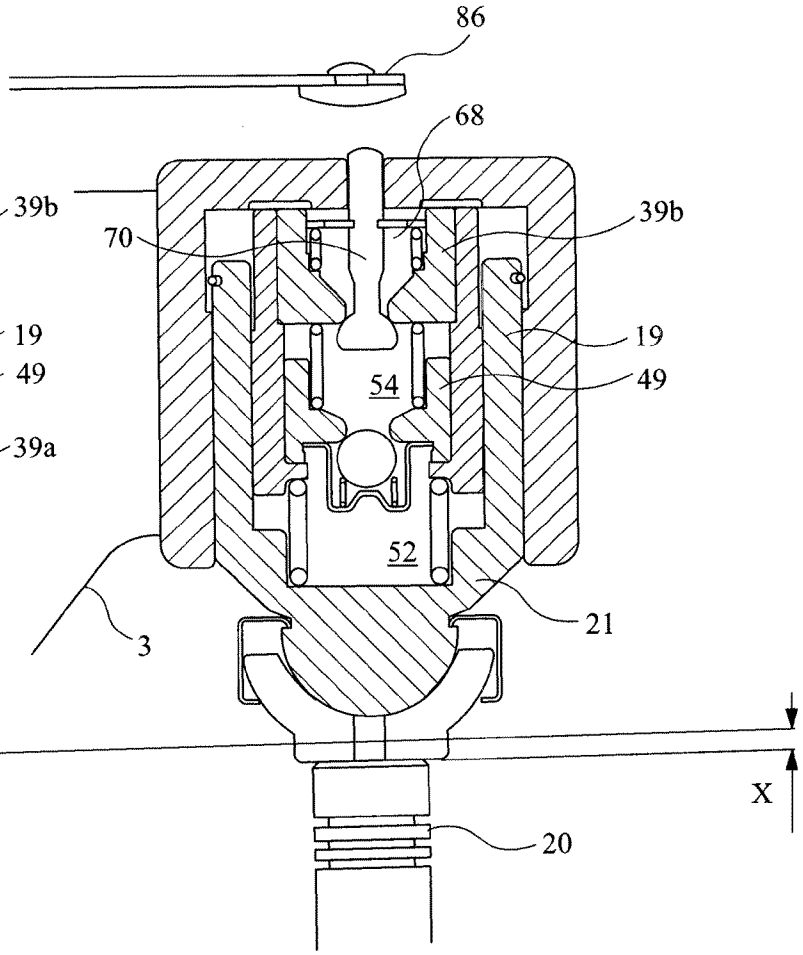
FIG. 6*b* is a schematic cross sectional side view of an HLA.
Figure 6A:
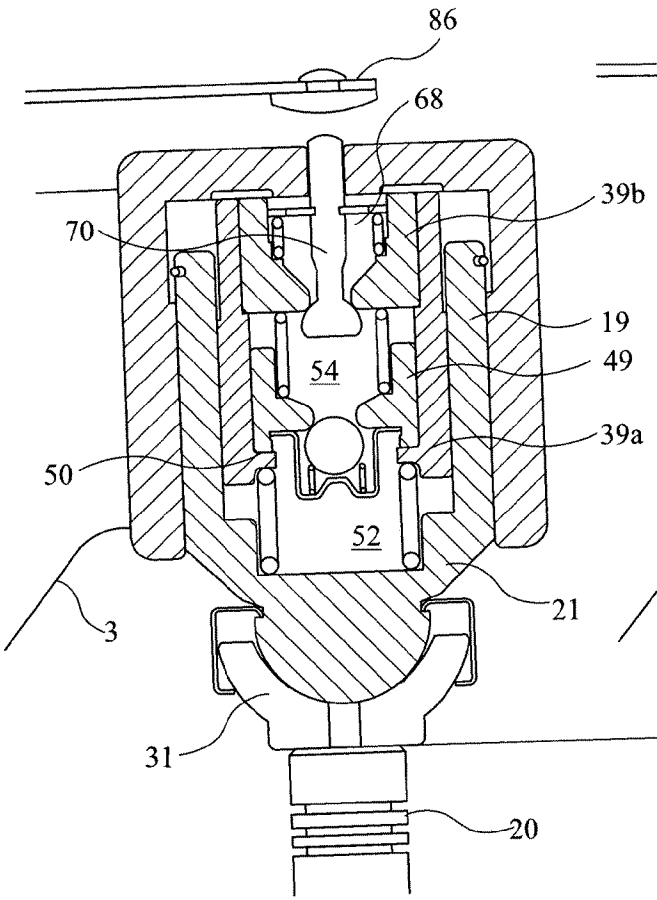
FIG. 6*a* is a schematic cross sectional side view of an HLA.
Figure 7:
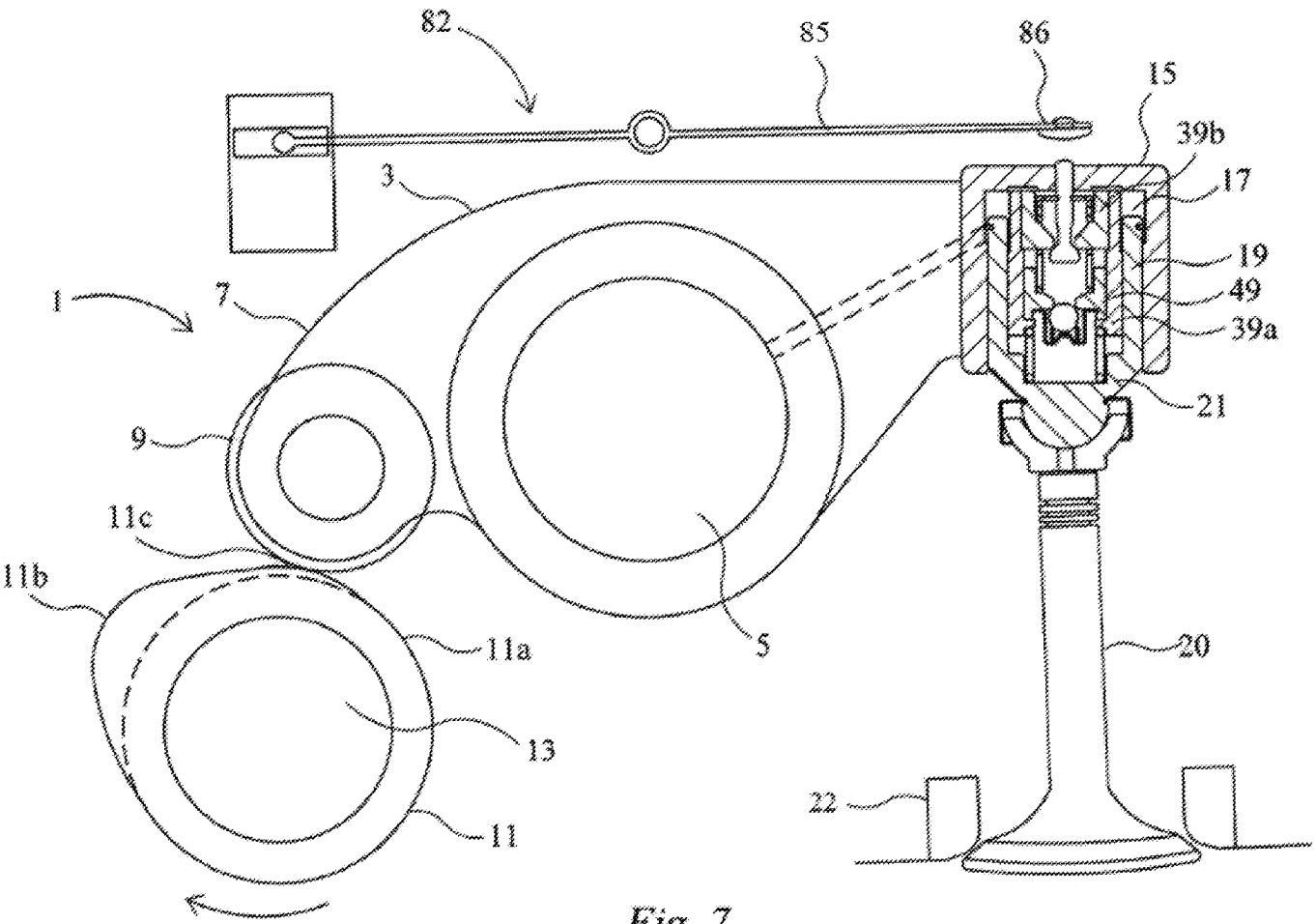
FIG. 7 is a schematic side view of a valve train assembly.

FIG. 6*a* is an enlarged view of the HLA 19 as it is in FIG. 5 and shows that the second plunger 49 rests upon the annular lip 50 formed around the bottom of the first hollow body 39*a*.

As the roller 9 starts to engage the leading rising slope of the additional exhaust lift profile 11*c*, the exhaust rocker arm 3 starts to pivot clockwise in the sense of the page. In this mode of operation, because the relief valve 70 is closed, as the exhaust rocker arm 3 pivots, the oil pressure exerted by the oil in the second chamber 54 on the second plunger 49 and oil pressure exerted by the oil in the first chamber 52 on the second plunger 49 remain balanced so that the first plunger 39 cannot move inwardly of the hollow outer body 21 and the second plunger 49 cannot move upwards towards the second hollow body 39*b*. Instead, the HLA 19 acts immediately as a solid body, due to the incompressibility of the oil in the first oil chamber 52, and pushes down on the valve stem to open the exhaust valve 20. The timing of the opening of the exhaust valve 20 is such that it opens by the end of the compression stroke of the engine cylinder so that compressed air is charged from the cylinder to provide de-compression engine braking. The maximum valve lift X (e.g. 1.9 mm) of this additional valve event occurs when the roller 9 engages the peak of the additional exhaust lift profile 11*c*, see FIG. 7. FIG. 6*b* is an enlarged view of the HLA 19 as it is in FIG. 7 and line have been drawn across FIGS. 6*a* and 6*b* to illustrate the valve lift X.

When the roller 9 engages the rising slope of the main exhaust lift profile 11*b*, the exhaust rocker arm 3 pivots clockwise to a greater extent than when the roller 9 engages the rising slope of the additional exhaust lift profile 11*c*, and the HLA 19 acts on the exhaust valve 20 to fully open it for the exhaust stroke of the engine cycle. The maximum valve lift of the exhaust valve 20 occurs when the roller 9 engages the peak of the main exhaust lift profile 11*b*. As in combustion mode, as the roller 9 passes out of engagement with the peak of the main exhaust lift profile 11*b* the exhaust valve 20 begins to close under the action of a valve return spring and is fully closed when the roller 9 returns into engagement with the base circle 11*a*.

Figure 8:
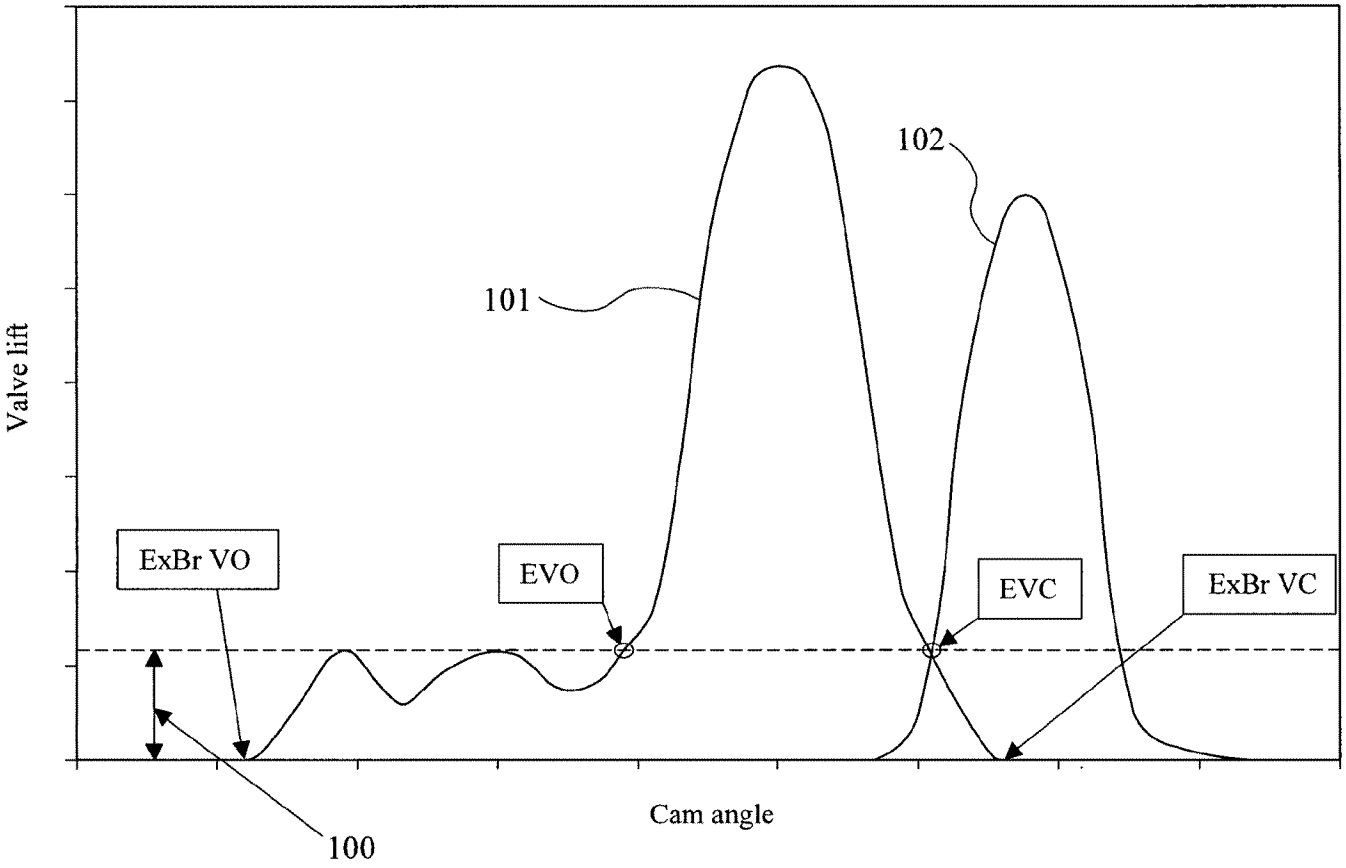
FIG. 8 shows a plot of valve lift against cam angle.

FIG. 8 shows a plot of valve lift against cam rotation angle. The curve 101 is for the exhaust valve 20 and the curve 102 is for a corresponding intake valve for the engine cylinder, which is acted on by an intake rocker arm in response to an intake cam. The lost motion stroke absorbed by the HLA 19 in the combustion mode is illustrated by the double headed arrow 100. In the combustion mode, the exhaust valve 20 remains shut during the 'lost motion stroke' and the exhaust valve opens at the point marked 'EVO' and closes at the point marked 'EVC'. In the brake mode, the exhaust valve 20 begins opening at the point ExBr VO for the additional valve event by the end of the cylinder's compression stroke, to enable compressed air to be discharged from the cylinder. It closes at the point ExBbVc after the main exhaust lift. It will be appreciated that the exact movement of the valve during the additional valve lift will be dictated by the shape of the additional cam lift profile 11*c*.

Figure 9C:
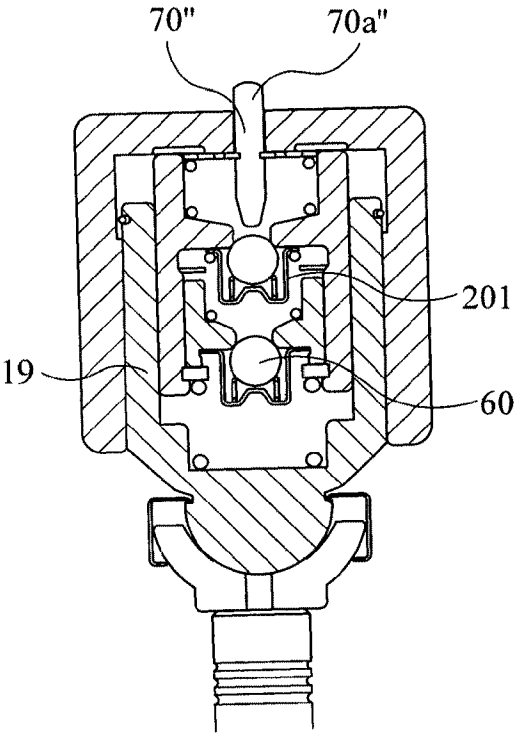
FIGS. 9*a*, 9*b* and 9*c* each show schematic cross sectional side views of alternative HLAs.
Figure 9B:
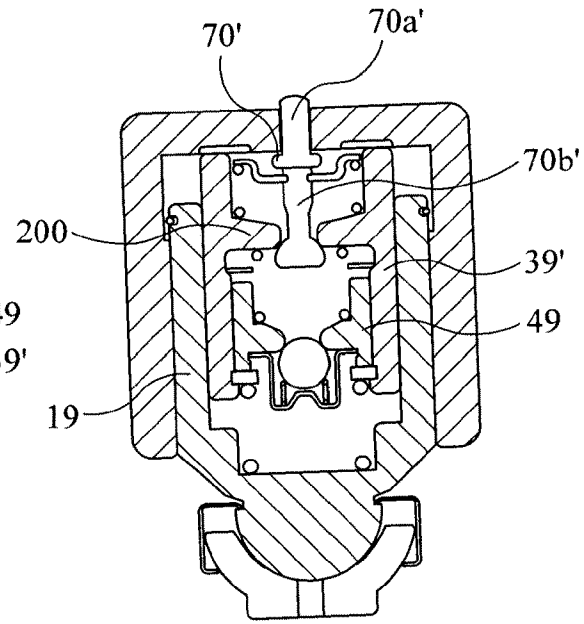
Figure 9A:
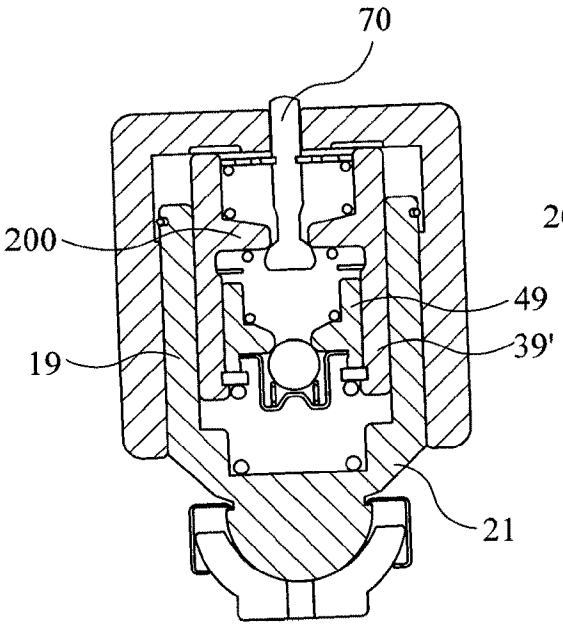

FIGS. 9*a* to 9*c* illustrate alternative HLAs 19 that may be used in embodiments of the invention. In these Figures, like reference numerals refer to like features previously described.

In each of FIGS. 9*a* to 9*c* the first hollow plunger 39' is a single piece component rather than a two piece component as described above. The plunger 39' has an annular region 200 that defines the second aperture 64 and provides a contact surface for stopping the second plunger 49.

In FIG. 9*b*, the relief valve 70' is a two piece component comprising a first part 70*a'* which extends from the HLA 19 and which is contactable by the actuator 82, and a second part 70*b'* which is acted upon by the first part 70*a'* to open the second aperture 64.

In FIG. 9*c*, the relief valve 70" comprises a valve needle 70*a"* which extends from the HLA 19 and which is movable by the actuator 82 , to act upon a check ball valve 201 to open the second aperture 64. The check ball valve 201 has a similar function and components to the check ball valve 60 that closes the first aperture 51.

The above embodiments are to be understood as an illustrative example of the invention only. Further embodiments of the invention are envisaged. For example, although in the above described embodiment the HLA is supported in a rocker arm, this need not be the case, and the HLA may be supported in a different location or in a different component in a valve train. Although in the above embodiment the HLA acts directly on an engine valve this need not be the case. Although in the above embodiment the HLA acts on a single valve it may act on multiple valves, for example, by acting on a valve bridge or other such component that carries multiple valves. Although in the above described embodiment the HLA is used in conjunction with an engine decompression braking operation, uses in conjunction with other operations, for example, Exhaust Gas Recirculation are envisaged. Although in the above described embodiment the lost motion arrangement of the HLA is used to entirely inhibit the additional exhaust valve lift when in combustion mode (i.e. the additional lift does not occur at all), it may be used to partially inhibit valve events (e.g. a valve does lift but not to the extent that it otherwise would have done). Further equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A hydraulic lash adjuster for an engine valve train, the hydraulic lash adjuster comprising:

a hydraulic lash adjusting arrangement configured to automatically compensate for lash in the engine valve train, the hydraulic lash adjusting arrangement comprising:

a first chamber configured to contain hydraulic fluid;

a second chamber configured to contain hydraulic fluid, the second chamber being located above the first chamber;

a third chamber configured to contain hydraulic fluid, the third chamber being located above the second chamber;

a first body;

a second body disposed for sliding reciprocal movement within the first body;

a first valve between the first chamber and the second chamber, the first valve comprising a ball captured by a cage; and a third body disposed for sliding reciprocal movement within the second body;

a lost motion arrangement configured to inhibit motion, induced in the engine valve train in response to a lift profile of a rotating cam, from being transferred to an engine valve, the lost motion arrangement comprising:

the second body; and the third body; and a relief valve configured to open an aperture into the second chamber, the relief valve extending along a central axis of the second chamber, the central axis extending axially through the aperture, the relief valve comprising an elongate stem or needle that extends along a longitudinal axis of the third chamber and through an upper wall of the hydraulic lash adjuster, wherein the first, second and third bodies are configured so that a displacement of hydraulic fluid in the first chamber resulting from a relative movement between the second body with respect to the first body results in a pressure difference between the first chamber and the second chamber so as to move the third body, inhibiting motion induced in the engine valve train in response to the lift profile of the rotating cam from being transferred to the engine valve, and wherein the first chamber comprises a space defined by the first body, the second body, and the third body.

2. The hydraulic lash adjuster of claim 1, which can be configured in a first operational mode and a second operational mode, wherein, in the first operational mode, the lost motion arrangement is enabled, and wherein, in the second operational mode, the lost motion arrangement is disabled.

3. The hydraulic lash adjuster of claim 1 further comprising:

a stop member configured to stop further movement of the third body when the third body moves into contact with it, wherein the hydraulic lash adjuster then acts as a solid body.

4. The hydraulic lash adjuster of claim 3, further comprising:

a biasing element configured to bias the third body away from the stop member.

5. The hydraulic lash adjuster of claim 3, wherein the stop member is integral with the second body.

6. The hydraulic lash adjuster of claim 3, wherein the stop member is a component of the second body.

7. The hydraulic lash adjuster of claim 1, wherein, in use, when the relief valve is open, the lost motion arrangement is enabled, and when the relief valve is closed hydraulic fluid in the first chamber and the second chamber causes the hydraulic lash adjuster to act as a solid body so as to disable the lost motion arrangement.

8. The hydraulic lash adjuster of claim 7, wherein the aperture fluidly connects the second chamber and the third chamber when the relief valve is open.

9. The hydraulic lash adjuster of claim 7, further comprising:

an actuator configured to actuate the relief valve.

10. The hydraulic lash adjuster of claim 1, wherein the cage of the first valve is supported by the third body, and wherein the first valve is carried by the third body when the third body moves.

11. The hydraulic lash adjuster of claim 1, further comprising:

a first biasing element configured to bias the second body away from the first body.

12. The hydraulic lash adjuster of claim 11, further comprising:

a second biasing element configured to bias the third body away from a stop member of the hydraulic lash adjuster, the stop member being configured to stop further movement of the third body when the third body moves into contact with it.

13. A valve train for an engine, comprising the hydraulic lash adjuster of claim 1.

14. The valve train of claim 13, wherein the lost motion arrangement is useable to inhibit an additional valve lift of the engine valve.

15. The valve train of claim 14, wherein the engine valve is an exhaust valve.

16. The valve train of claim 15, wherein the additional valve lift is a de-compression engine brake valve event which the lost motion arrangement inhibits when in an engine combustion mode.

* * * * *